US010180132B2

(12) United States Patent
Ryu et al.

(10) Patent No.: US 10,180,132 B2
(45) Date of Patent: Jan. 15, 2019

(54) MOBILE HYDRAULIC GENERATOR AND CONTROL METHOD THEREOF

(71) Applicant: KNR Systems Inc., Gyeonggi-do (KR)

(72) Inventors: Sung Moo Ryu, Gyeonggi-do (KR); Seong Cheol Jang, Gyeonggi-do (KR); Hyoung Kwon Kim, Gyeonggi-do (KR); Young Ho Choo, Gyeonggi-do (KR); Dae Gyeong Kim, Gyeonggi-do (KR)

(73) Assignee: KNR Systems, Inc. (KR)

( * ) Notice: Subject to any disclaimer, the term of this patent is extended or adjusted under 35 U.S.C. 154(b) by 674 days.

(21) Appl. No.: 14/327,864

(22) Filed: Jul. 10, 2014

(65) Prior Publication Data

US 2015/0017019 A1 Jan. 15, 2015

(30) Foreign Application Priority Data

Jul. 10, 2013 (KR) ..... 10-2013-0080711

(51) Int. Cl.

| | |
|---|---|
| ***F15B 21/00*** | (2006.01) |
| ***F15B 1/26*** | (2006.01) |
| ***F15B 7/00*** | (2006.01) |
| ***F04B 35/06*** | (2006.01) |
| ***F04B 41/02*** | (2006.01) |

(Continued)

(52) U.S. Cl.

CPC ..... *F04B 41/02* (2013.01); *F04B 35/06* (2013.01); *F04B 41/06* (2013.01); *F04B 49/065* (2013.01); *F04B 49/08* (2013.01); *F04B 49/20* (2013.01); *F04D 15/029* (2013.01); *F04B 2205/173* (2013.01); *F04D 15/0066* (2013.01)

(58) Field of Classification Search

CPC .. F04B 2203/0209; F04B 41/06; F04B 49/08; F04B 49/20; F04B 35/06; F04B 41/02; F04B 49/065; F04B 2205/05; F04B 2205/173; F04D 15/0066; F04D 15/029; F04D 15/00

See application file for complete search history.

(56) References Cited

U.S. PATENT DOCUMENTS 4,225,290 A * 9/1980 Allington ..... G01N 30/34 318/48
4,920,748 A * 5/1990 Kordak ..... F04B 49/08 60/414

(Continued)

FOREIGN PATENT DOCUMENTS

JP 2013-015205 1/2013
KR 1020040096883 11/2004

*Primary Examiner* — Dominick L Plakkoottam
(74) *Attorney, Agent, or Firm* — Occhiuti & Rohlicek LLP

(57) ABSTRACT

A flow generator includes pumps operated by motors to generate an amount of a hydraulic fluid, a proportional hydraulic control valve to control output hydraulic pressure according to the amount of the hydraulic fluid, a pressure sensor to detect the output hydraulic pressure, and a hydraulic servo loop controller to which a required hydraulic pressure and a required amount of fluid are input by a user. Based on a feedback signal representing the output hydraulic pressure, the controller generates a pressure control signal for controlling the proportional hydraulic control valve based on the required hydraulic pressure and a change in the output hydraulic pressure. It also generates an RPM input signal for controlling a motor's RPM.

7 Claims, 10 Drawing Sheets

(51) Int. Cl.

| | |
|---|---|
| ***F04B 41/06*** | (2006.01) |
| ***F04B 49/06*** | (2006.01) |
| ***F04B 49/08*** | (2006.01) |
| ***F04B 49/20*** | (2006.01) |
| ***F04D 15/02*** | (2006.01) |
| *F04D 15/00* | (2006.01) |

(56) References Cited

U.S. PATENT DOCUMENTS 5,259,731 A * 11/1993 Dhindsa ..... F04B 49/065 417/3
5,388,761 A * 2/1995 Langeman ..... B01F 15/00285 222/138
5,454,762 A * 10/1995 Sawase ..... B60K 23/04 475/250
5,522,707 A * 6/1996 Potter ..... B23Q 11/1038 417/4
5,743,089 A * 4/1998 Tohji ..... E02F 9/2235 60/450
6,219,608 B1 * 4/2001 Abo ..... F16H 61/66259 474/28
6,311,488 B1 * 11/2001 Maruta ..... F01P 7/044 60/445
2005/0241318 A1 * 11/2005 Buehman ..... F02C 7/22 60/773
2006/0045750 A1 * 3/2006 Stiles ..... F04B 49/20 417/42
2008/0208426 A1 * 8/2008 Iwasaki ..... B60T 1/10 701/70
2012/0027621 A1 * 2/2012 Sun ..... H02P 27/024 417/45
2014/0188321 A1 * 7/2014 Ishida ..... B60W 10/06 701/22
2014/0203041 A1 * 7/2014 Komatsu ..... F04D 15/0066 222/63

* cited by examiner

MOBILE HYDRAULIC GENERATOR AND CONTROL METHOD THEREOF

CROSS-REFERENCE TO RELATED APPLICATIONS

This application claims the benefit of priority of Korean Patent application No. 10-2013-0080711 filed on Jul. 10, 2013, all of which are incorporated by reference in their entirety herein.

BACKGROUND OF THE INVENTION

Field of the Invention

The present invention relates to a mobile hydraulic generator and a method of controlling the same, and more particularly, to a mobile hydraulic generator capable of controlling an amount and pressure of a hydraulic fluid and a control method thereof.

Description of the Related Art

A hydraulic pump may be classified into a piston pump, a gear pump, a vane pump, and the like according to an element to push a hydraulic fluid and an operation principle of the element. The piston pump may be classified into a swash type pump and a bent axis type axial piston pump. The swash type pump is driven in an axis direction according to an angle of a swash plate. The bent axis type axial piston pump is driven in an axis direction according to a tilted angle of two axes.

The swash type pump uses a scheme to mechanically control a discharged amount of a fluid per rotation by controlling an angle of an internal tilt plate of a pump. If pressure loss occurs, a swash angle of the swash type pump is controlled by mechanical feedback. The swash type pump has an advantage that it does not need an electronic circuit. However, the swash type pump is operated after the pressure of the fluid is reduced. Accordingly, the swash type pump has a difficulty in rapidly compensating for the pressure after the pressure loss previously occurs.

Further, since the swash type pump has a relatively complicated structure, costs of a relatively large pump and a high performance swash type pump are very expensive. Accordingly, the swash type pump is not suitable for a device having a great variation in a flow rate, for example, a mobile robot and the like.

Meanwhile, when a device using hydraulic pressure is operated, the speed of a motor may be used in order to control the flow rate. In order to easily control the flow rate, it is preferable to drive a motor during a maximum efficiency interval of a total operation interval of the motor. However, the maximum efficiency interval is only a part of the total operation interval. Accordingly, speed of the motor should be rapidly changed corresponding to a rapidly changed flow rate. When speeds of general high inertia motors are changed, the efficiency thereof is frequently and significantly deteriorated.

SUMMARY OF THE INVENTION

The present invention has been made in an effort to solve the above problems, and provides a mobile hydraulic generator having rapid response by scattering a small motor for generating a flow of fluid and a small pump and a control method thereof.

The present invention further provides a hydraulic supply apparatus for driving a low cost and high efficiency mobile robot.

According to an aspect of the present invention, there is provided a mobile hydraulic generator including: a flow generator including n pumps operated by n motors to generate an amount of a hydraulic fluid; a proportional hydraulic control valve to control output hydraulic pressure according to the amount of the hydraulic fluid; a pressure sensor to detect the output hydraulic pressure; and a hydraulic servo loop controller to which required hydraulic pressure and required amount of fluid are input by a user, to feedback the output hydraulic pressure, to generate a pressure control signal for controlling the proportional hydraulic control valve based on a change amount of the output hydraulic pressure and to generate an RPM input signal for controlling RPM of the n motors.

According to another aspect of the present invention, there is provided a control method of a mobile hydraulic generator including: a command input step of inputting required hydraulic pressure and required amount of fluid to a hydraulic servo loop controller by a user; a fluid amount generating step of generating an amount of a hydraulic fluid by a flow generator including n motors and n pumps; a hydraulic pressure feedback step of detecting an output hydraulic pressure output according to the amount of a hydraulic fluid and feedbacking the output hydraulic pressure to the hydraulic servo loop controller; and a hydraulic servo loop control step of generating a pressure control signal for controlling the proportional hydraulic control valve based on change amounts of the required hydraulic pressure and the output hydraulic pressure and generating an RPM input signal for controlling RPM of the n motors.

The mobile hydraulic generator and the method of controlling the same can ensure rapid response and high efficiency.

The mobile hydraulic generator and the method of controlling the same can miniaturize total equipment.

BRIEF DESCRIPTION OF THE DRAWINGS

Arrangements and embodiments may be described in detail with reference to the following drawings in which like reference numerals refer to like elements and wherein.

DESCRIPTION OF THE PREFERRED EMBODIMENT

Embodiments may be described with reference to appended drawings. For the description of the embodiments, same names and symbols may be used for the same structure and an additional description according thereto may not be provided below.

Hereinafter, a mobile hydraulic generator and a control method thereof according to the present invention will be described with reference to accompanying drawings.

Figure 1:
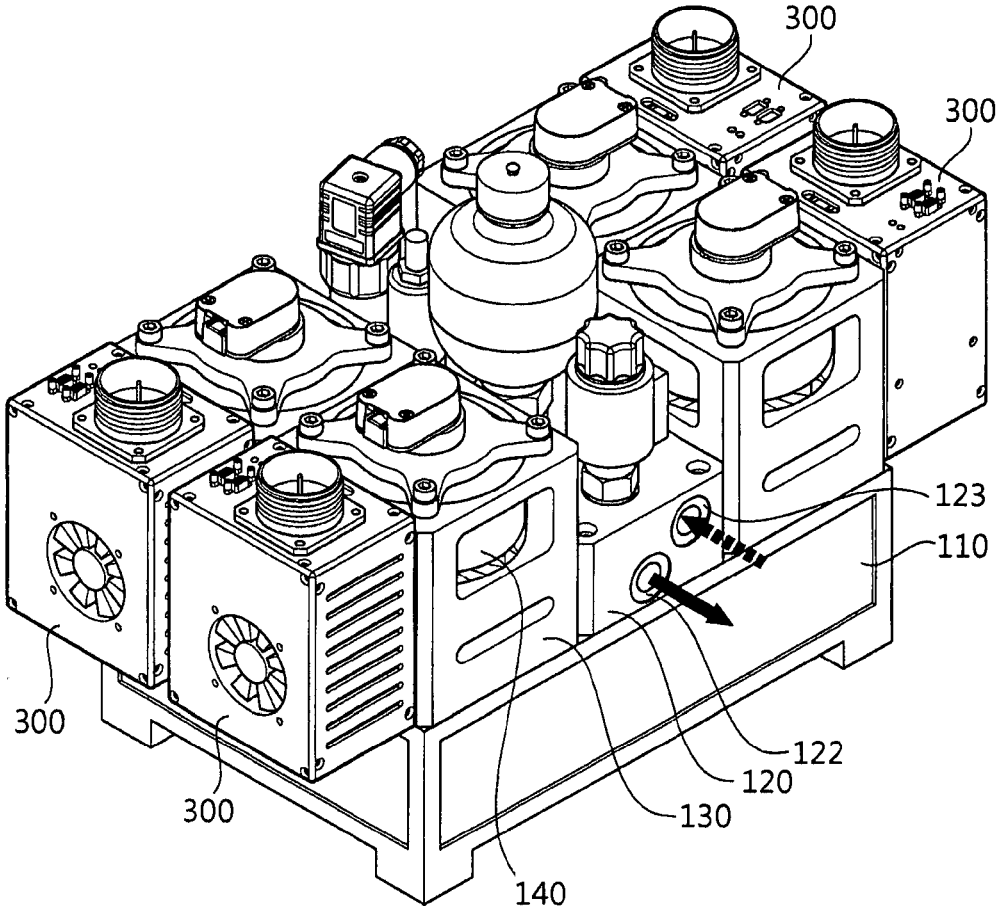
FIG. 1 is a perspective view illustrating a part of a mobile hydraulic generator according to an exemplary embodiment of the present invention.
Figure 2:
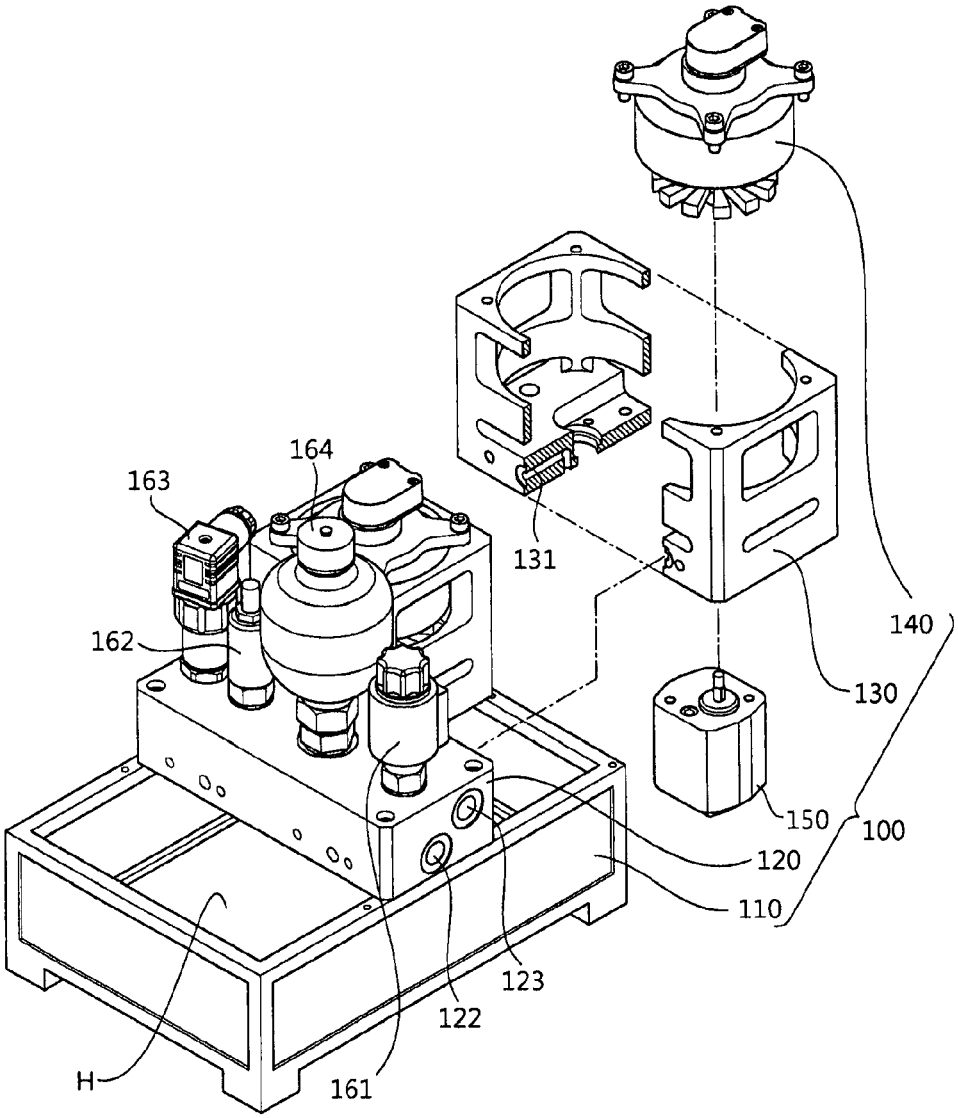
FIGS. 2 and 3 are exploded perspective views illustrating a combination relation of a part of a mobile hydraulic generator according to an exemplary embodiment of the present invention shown in FIG. 1.
Figure 3:
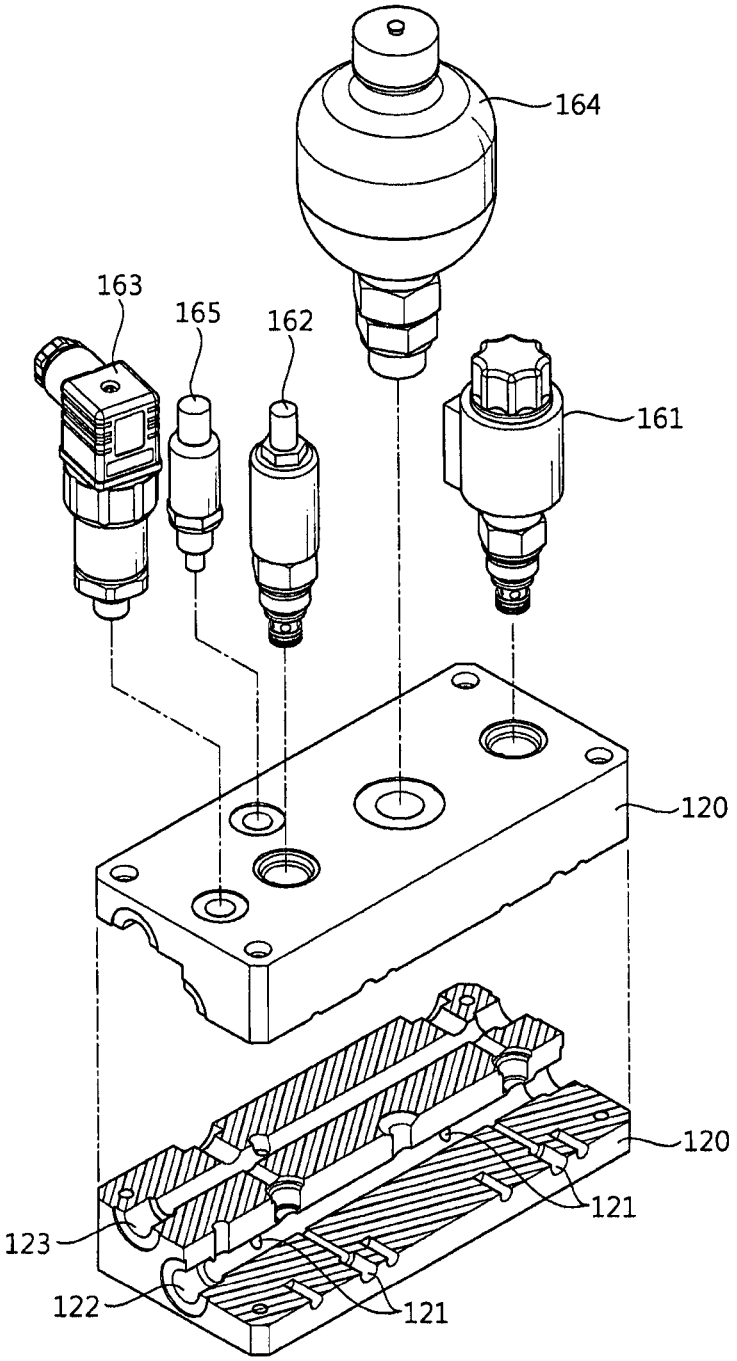

FIG. 1 is a perspective view illustrating a part of a mobile hydraulic generator according to an exemplary embodiment of the present invention, and FIGS. 2 and 3 are exploded perspective views illustrating a combination relation of a part of a mobile hydraulic generator according to an exemplary embodiment of the present invention shown in FIG. 1.

Referring to FIGS. 1 to 3, the mobile hydraulic generator according to an exemplary embodiment of the present invention may include a flow generator 100. The flow generator 100 may include a storage tub 110, a manifold 120, n (n is a natural number) housings 130, n (n is a natural number) motors 140, and n pumps 150.

The storage tub 110 may include a body with an open top end. The manifold 120 may be coupled with an upper portion of the storage tub 110. The n housings 130 may be coupled with both sides of the manifold 120. The motor 140 and the pump 150 may be vertically disposed inside each housing 130. The motor 140 may be connected to the pump 150 so that the pump 150 may be driven by the motor 140.

A hydraulic fluid is received inside the storage tub 110. A plurality of passages forming a path of the hydraulic fluid may be formed inside the manifold 120. The manifold 120 may be formed therein with n introduction passages 121, n supply passages 122, and n circulating passages 123.

The n introduction passages 121 are open in both side directions of the manifold 120. A communication passage 131 is formed at a side wall of each housing 130. An end of the communication passage 131 is open to the side wall of each housing 130 making contact with the manifold 120. Accordingly, the communication passage 131 may communicate with the introduction passage 121. Another end of the communication passage 131 is open to the storage tub 110. Accordingly, the communication passage 131 may communicate with the storage tub 110. Accordingly, if the n pumps 150 are driven, the hydraulic fluid inside the storage tub 110 may be introduced into the n introduction passages 121 through each communication passage 131.

Meanwhile, a flow maintaining part 111 and a pressure maintaining part 112 may be disposed at a later side of the storage tub 110.

Figure 4:
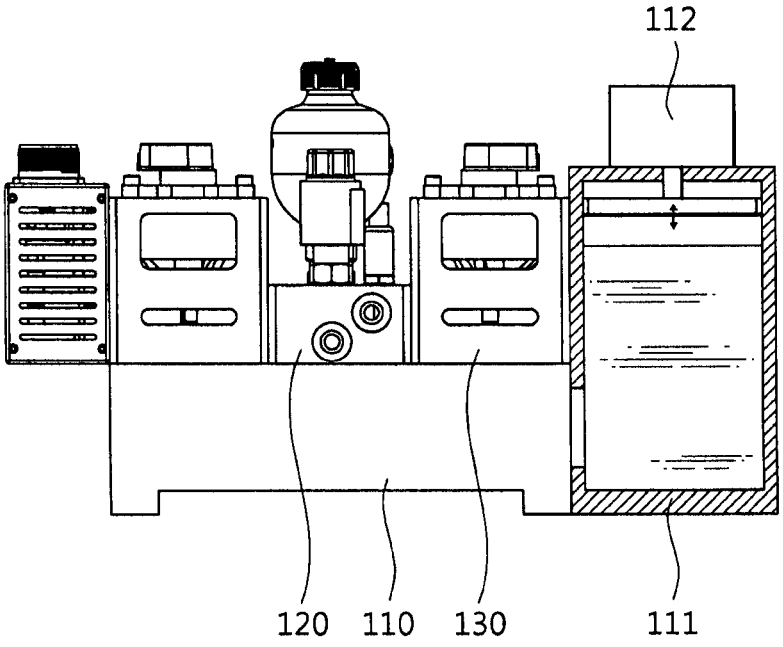
FIG. 4 is a partially sectional view illustrating a part of the mobile hydraulic generator according to an exemplary embodiment of the present invention.
Figure 5:
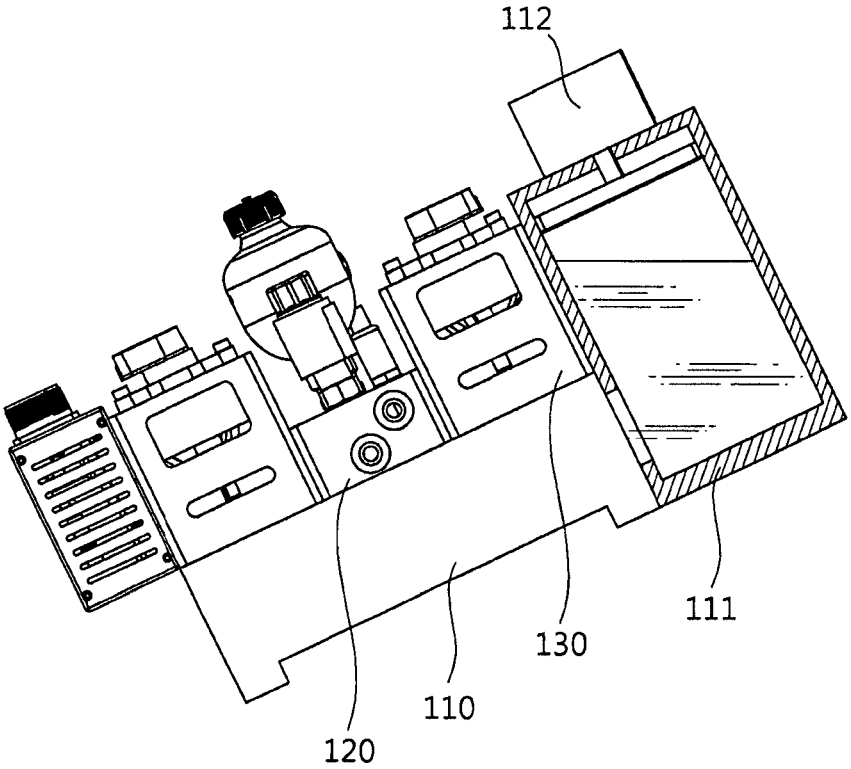
FIG. 5 is a partially sectional view illustrating a tilted state of the mobile hydraulic generator according to an exemplary embodiment of the present invention.

FIG. 4 is a partially sectional view illustrating a part of the mobile hydraulic generator according to an exemplary embodiment of the present invention, and FIG. 5 is a partially sectional view illustrating a tilted state of the mobile hydraulic generator according to an exemplary embodiment of the present invention.

Referring to FIGS. 4 and 5, the flow maintaining part 111 may be connected to a lateral side of the storage tub 110. The flow maintaining part 111 may have a container shape with a passage communicating with the storage tub 110. The flow maintaining part 111 may receive the hydraulic fluid therein.

When the storage tub 110 is tilted, the hydraulic fluid inside the storage tub 110 may be concentrated in a low side of the storage tub 110. Accordingly, if the storage tub 110 is tilted, the hydraulic fluid may not be supplied into the communication passage 131. As described above, if the hydraulic fluid is not supplied into the communication passage 131, cavitation may occur due to a rate variation or a pressure variation of the hydraulic fluid. Accordingly, the hydraulic fluid received inside the flow maintaining part 111 may be introduced into the tilted storage tub 110. As described above, the flow maintaining part 111 compensates for an amount of the fluid inside the tilted storage tub 110 so that the hydraulic fluid may be easily supplied into the communication passage 131.

The pressure maintaining part 112 is installed at the flow maintaining part 111 to maintain pressure of the storage tub 110 and the flow maintaining part 111. FIGS. 4 and 5 illustrate the pressure maintaining part 112 in a piston form to control internal pressure inside the flow maintaining part 111. As another embodiment, the pressure maintaining part 112 may be modified to bellows, a bladder, an accumulator, and the like.

Referring back to FIGS. 1 and 3, the supply passage 122 and the circulating passage 123 are spaced apart from each other in a longitudinal direction of the manifold 120. An end of the supply passage 122 is open toward an outer portion of the manifold 120 and may be connected to a supply pipe which is not shown. The supply pipe (not shown) may be connect the supply passage 122 and the hydraulic actuator 10 to each other to guide the hydraulic fluid to the hydraulic actuator 10. The n introduction passages 121 are merged in the supply passage 122. Accordingly, the hydraulic fluid introduced inside the manifold 120 may be merged in the supply passage 122.

As described above, hydraulic pressure changed according to a flow rate of the hydraulic fluid merged from the n introduction passages 121 is output to the supply passage 122. The hydraulic actuator connected to the supply pipe (not shown) may be operated according to output hydraulic pressure formed in the supply passage 122.

An end of the circulating passage 123 is open to an outside of the manifold 120 and may be connected to the circulating pipe (not shown). The circulating pipe (not shown) guides the hydraulic fluid returned from the hydraulic actuator 10 to the manifold 120.

The circulating passage 123 communicates with the supply passage 122 to circulate the hydraulic fluid returned from the hydraulic actuator 10 to the supply passage 122.

Although not shown, as another embodiment, the circulating passage 123 may configured to guide the hydraulic fluid into the storage tub 110. After the hydraulic fluid returned from the hydraulic actuator 10 is received in the storage tub 110, the received hydraulic fluid may be again supplied into the supply passage 122 through the introduction passage 121. Further, although not shown, check valves to prevent the hydraulic fluid from reversely flowing may be provided between the supply passage 122 and the introduction passage 121, and between the supply passage 122 and the circulating passage 123, respectively.

As described above, the present embodiment has a structure where the storage tub 110 having an open top end is coupled with the manifold 120 and the n housings 130, and the hydraulic fluid is distributedly supplied by the n pumps 150 by operating the n motors 140 provided in the n housings 130. Accordingly, in the present embodiment, since the n motors 140 and the n pumps 150 are concentrated in a single storage tub 110 and the single manifold 120, the equipment may be miniaturized. In addition, according to the present embodiment, since the flow of the fluid may be distributedly supplied by the n pumps 150, a motor and a pump to form the flow of the fluid may be efficiently operated.

The foregoing embodiment has described a structure where the storage tub 110 is disposed at lower portions of the n housings 130 and the manifold 120 to miniaturize the flow generator 100, and a top end of the storage tub 110 may be opened or closed because the housings 130 and the manifold 120 may be separated from the storage tub 110. The storage tub 110 is provided separately from the n pumps 150 and the manifold 120. The storage tub 110 may be provided in the form of a pressure tank connected to the n pumps 150 and the manifold 120 by an additionally installed pipe.

Meanwhile, a proportional hydraulic control valve 161, a manual hydraulic control valve 162, a pressure sensor 163, an accumulator 164, and a temperature sensor 165 may be installed at an upper portion of the manifold 120.

The proportional hydraulic control valve 161, the manual hydraulic control valve 162, the pressure sensor 163, and the accumulator 164 may be provided to communicate with the supply passage 122. The proportional hydraulic control valve 161 controls the output hydraulic pressure. The proportional hydraulic control valve 161 may be controlled by a hydraulic servo loop controller 200 (see FIG. 6) which will be described later. The manual hydraulic control valve 162 prevents the output hydraulic pressure from exceeding preset maximum pressure. The pressure sensor 163 detects the output hydraulic pressure. The accumulator 164 stores a part of pressure formed in the supply passage 122 and compensates for output hydraulic pressure using the stored pressure to prevent surging of the output hydraulic pressure. The temperature sensor 165 may be installed to communicate with the circulating passage 123. The temperature sensor 165 detects a temperature of the returning hydraulic fluid from the hydraulic actuator 10.

Meanwhile, the present embodiment may include the proportional hydraulic control valve 161, the hydraulic servo loop controller 200 to control RPM of the n motors 140 and n motor servo loop controllers 300.

Figure 6:
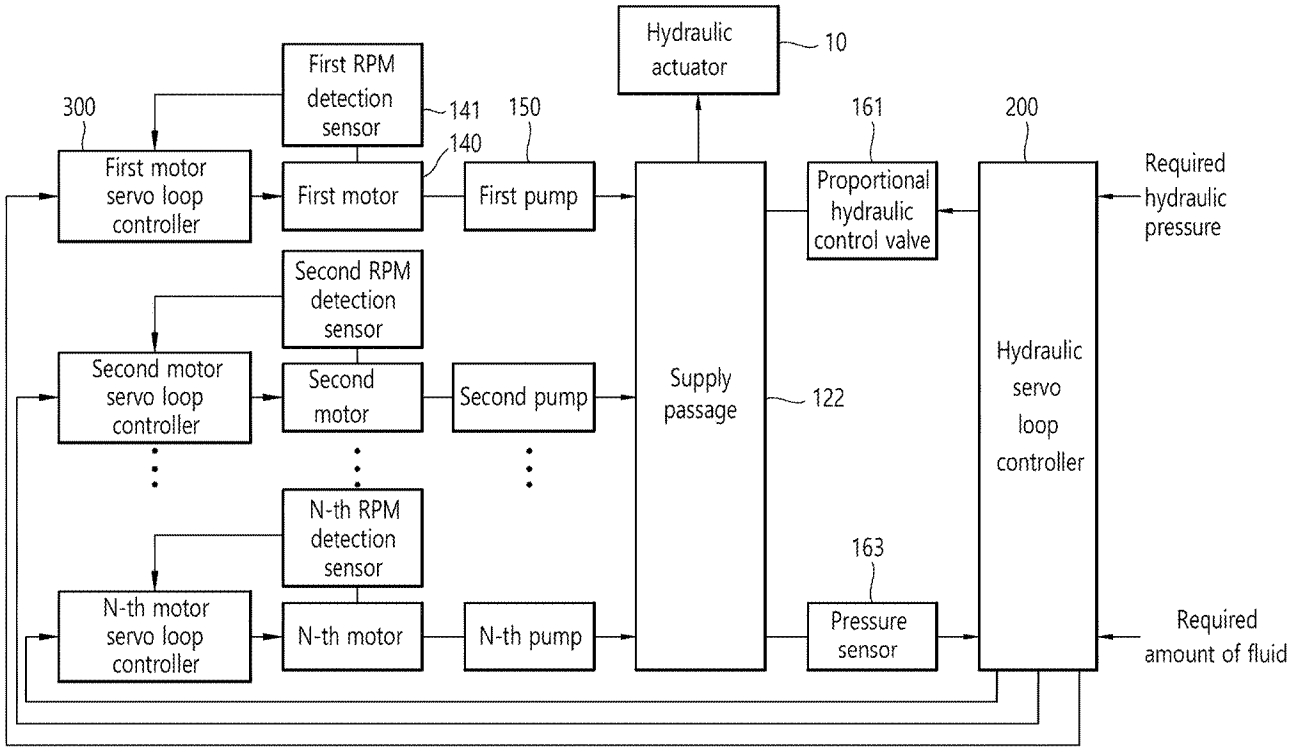
FIG. 6 is a block diagram simply illustrating a combination relation of a flow generator, a hydraulic servo loop controller, and a motor servo loop controller of the mobile hydraulic generator according to an exemplary embodiment of the present invention.

FIG. 6 is a block diagram simply illustrating a combination relation of a flow generator, a hydraulic servo loop controller, and a motor servo loop controller of the mobile hydraulic generator according to an exemplary embodiment of the present invention.

Referring to FIG. 6, the hydraulic servo loop controller 200 may be connected to the pressure sensor 163 and the proportional hydraulic control valve 161. The required pressure and the required amount of fluid are input to the hydraulic servo loop controller 200 by a user, and the output hydraulic pressure detected by the pressure sensor 163 may be feedbacked to the hydraulic servo loop controller 200

Assuming that N (N is a natural number) hydraulic actuators 10 are installed, the required pressure may be changed by the user according to the number of the hydraulic actuators 10 and a load state of the hydraulic actuator 10, and the required amount $Q_{all}$ of the fluid may be calculated by a following equation 1.

$$Q_{all} = \alpha \cdot \left( \sum_{i=1}^{N} X_i \cdot A_i \right) + \beta \quad \text{[Equation 1]}$$

In the equation 1, the a and the β represent a residual fluid amount parameter, the $x_i$ represents required speed of an i-th hydraulic actuator, and the $A_i$ represents a sectional area of the hydraulic actuator.

Although not shown, a digital-analog converter (not shown) for converting a digital signal output from the hydraulic servo loop controller 200 into an analog signal may be provided between the hydraulic servo loop controller 200 and the proportional hydraulic control valve 161. Further, an analog-digital converter (not shown) for converting an analog signal output from the pressure sensor 163 into a digital signal may be provided between the pressure sensor 163 and the hydraulic servo loop controller 200.

Figure 7:
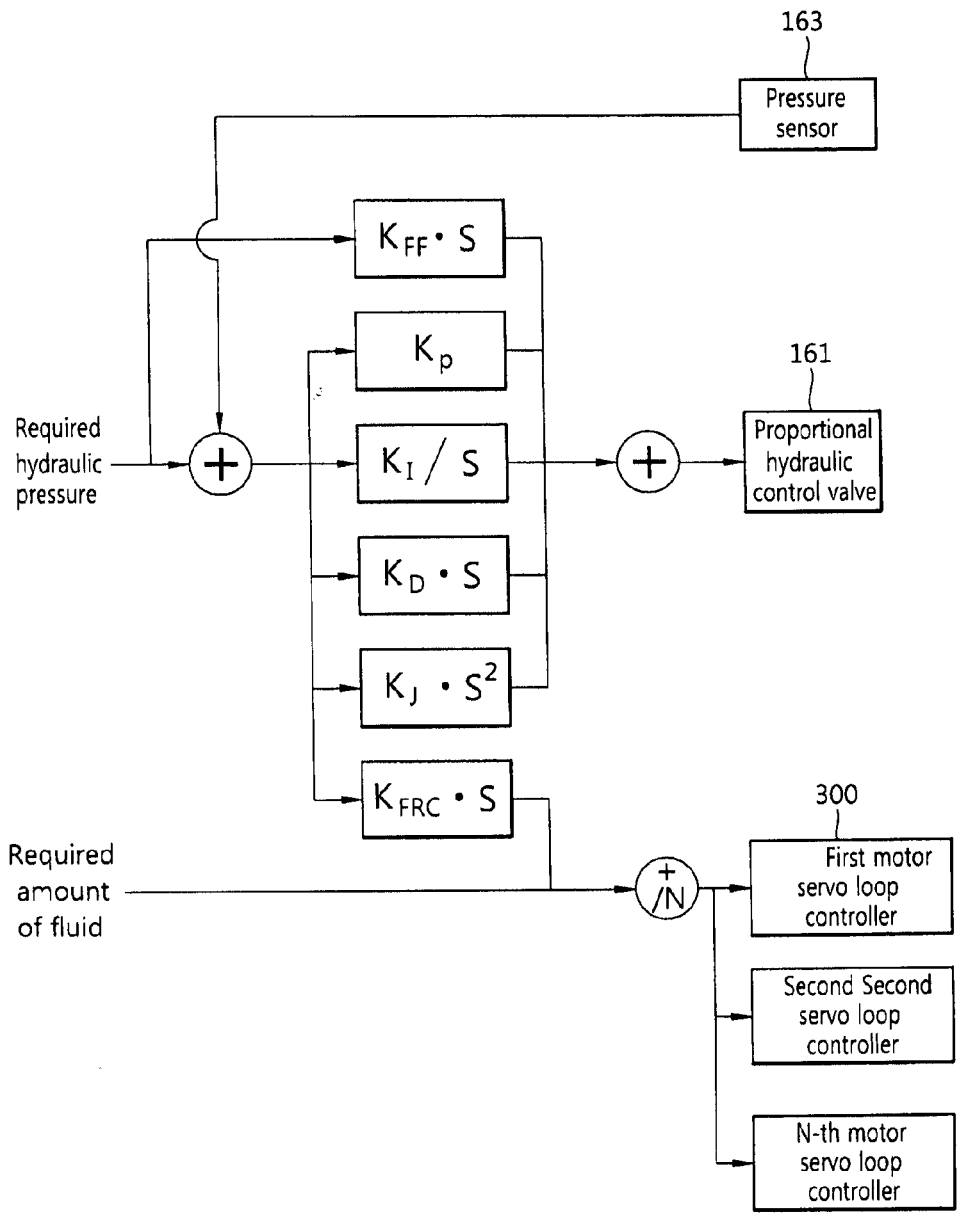
FIG. 7 is a block diagram illustrating a configuration of the hydraulic servo loop controller of the mobile hydraulic generator according to an exemplary embodiment of the present invention.

FIG. 7 is a block diagram illustrating a configuration of the hydraulic servo loop controller of the mobile hydraulic generator according to an exemplary embodiment of the present invention.

Referring to FIG. 7, the hydraulic servo loop controller 200 generates a pressure control signal to control the proportional hydraulic control valve 161 and n RPM input signals to control RPM of the n motors.

That is, the pressure control signal may be calculated by combining feedforward calculation which is including data modeling a linear or non-linear drive characteristic based on the required hydraulic pressure, and proportional calculation, integral calculation, differential calculation, and double differential calculation which are based on the required hydraulic pressure and the change amount of the output hydraulic pressure.

Each RPM input signal may be calculated by combining flow rate compensation calculation with the required amount of fluid based on the required hydraulic pressure and the change amount of the output hydraulic pressure. The flow rate compensation calculation compensates for pressure drop which may be unexpectedly caused due to rapid use of an excessive amount of fluid during the operation of the hydraulic actuator.

Referring back to FIG. 6, each RPM input signal is input to each motor servo loop controller 300. In addition, the flow generator 100 may be configured including a RPM detection sensor 141 which is provided at each of the n motors 140 to detect an RPM of each motor 140.

Figure 8:
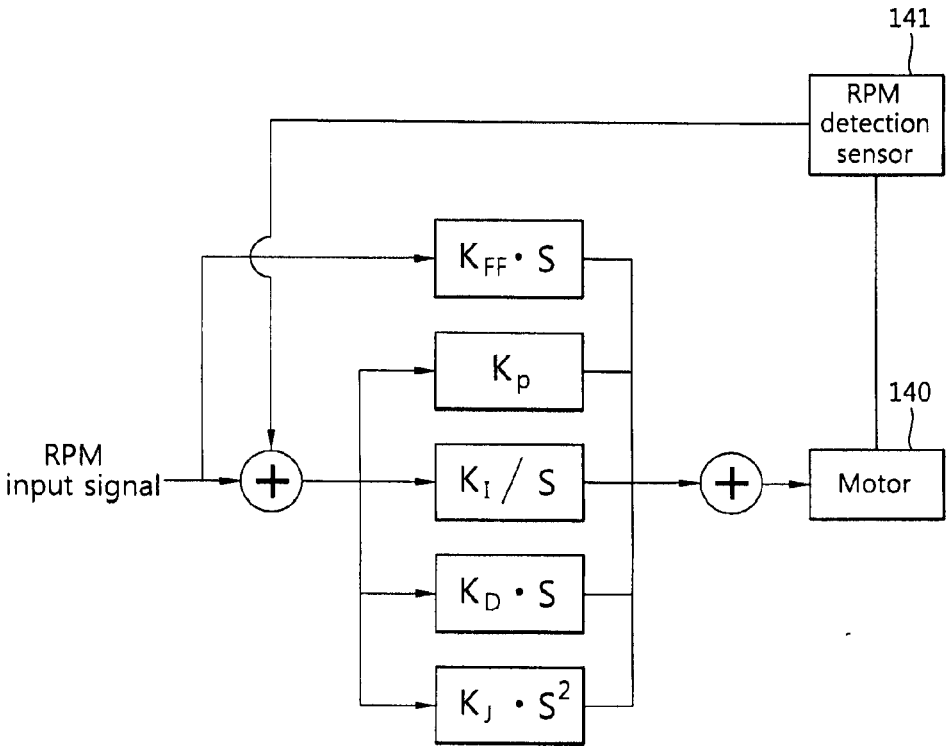
FIG. 8 is a block diagram illustrating a configuration of the motor servo loop controller of the mobile hydraulic generator according to an exemplary embodiment of the present invention.

FIG. 8 is a block diagram illustrating a configuration of the motor servo loop controller of the mobile hydraulic generator according to an exemplary embodiment of the present invention.

Referring to FIG. 8, each motor servo loop controller 300 may generate an RPM output signal for controlling the RPM of each motor. That is, the hydraulic servo loop controller 200 inputs the RPM input signal to each motor servo loop controller 300, and an output RPM of the motor 140 detected by the RPM detection sensor 141 is feedbacked to each motor servo loop controller 300.

The RPM output signal may be calculated by a combination of calculation using feedforward coefficient ($K_{FF}$) including data modeling a linear or non-linear drive characteristic of the hydraulic actuator 10 which is based on an RPM according to the RPM input signal, and using proportional coefficient ($K_P$), integral coefficient ($K_I$), differential coefficient ($K_D$), double differential coefficient (Ku), and flow rate compensation coefficient ($K_{FRC}$) which are based on an RPM according to the RPM input signal and a change amount of the output RPM.

As described above, the proportional hydraulic control valve 161 may be controlled according to the pressure control signal generated by the hydraulic servo loop controller 200 to control output hydraulic pressure. In addition, according to the present embodiment, the RPM input signal generated by the hydraulic servo loop controller 200 is input to n motor servo loop controller 300, and the RPM of each motor 140 is controlled according to the RPM output signal generated by each motor servo loop controller 300 so that the flow rate may be controlled.

Hereinafter, the method of controlling the hydraulic generator according to an embodiment of the present invention will be described with reference to the accompanying drawings.

Figure 9:
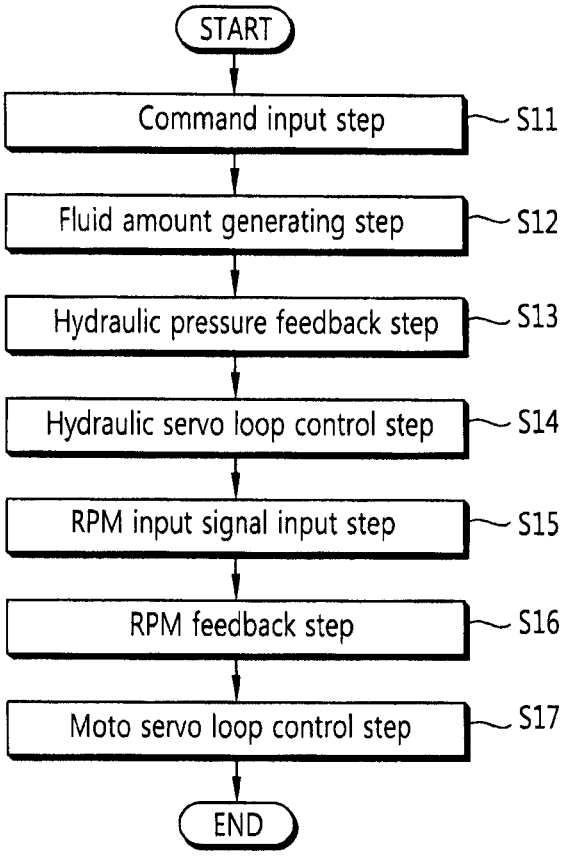
FIG. 9 is a flow chart illustrating a control method of the mobile hydraulic generator according to an exemplary embodiment of the present invention.

FIG. 9 is a flow chart illustrating a control method of the mobile hydraulic generator according to an exemplary embodiment of the present invention.

Referring to FIG. 9, the required amount of fluid and the required hydraulic pressure are input to the hydraulic servo loop controller 200 by a user. As described above, when the required amount of the fluid and the required hydraulic pressure are input to the hydraulic servo loop controller 200, the n motors 140 are operated so that the n pumps 150 are driven by the n motors 140. A hydraulic fluid inside the storage tub 110 is supplied into the supply passage 122 through the communication passage 131 and the introduction passage 121 by the drive of then pumps 150. Accordingly, output hydraulic pressure changed according to the flow rate is formed inside the supply passage 122.

In this case, the pressure sensor 163 detects the output hydraulic pressure. The detected output hydraulic pressure is feedbacked to the hydraulic servo loop controller 200. The hydraulic servo loop controller 200 generates a pressure control signal and an RPM input signal based on the input required hydraulic pressure and the output hydraulic pressure. That is, the hydraulic servo loop controller 200 controls a proportional hydraulic control valve 161 according to the pressure control signal calculated by a combination of linear compensation calculation including data modeling a linear or non-linear drive characteristic of the hydraulic actuator 10 based on the required hydraulic pressure, proportional calculation, integral calculation, differential calculation, and double differential calculation which are based on the required hydraulic pressure and the change amount of the output hydraulic pressure.

Further, the hydraulic servo loop controller 200 controls RPM of the n motors 140 by calculating the RPM input signal by a combination of the flow rate compensation calculation based on the required hydraulic pressure and the change amount of the output hydraulic pressure As described above, the RPM input signal generated by the hydraulic servo loop controller 200 is input to the motor servo loop controller 300. The motor servo loop controller 300 generates the RPM output signal based on the output RPM and an RPM according to the RPM input signal.

That is, the motor servo loop controller 300 controls the RPM of each motor 140 according to an RPM output signal calculated by a combination of linear compensation calculation including data modeling a linear or non-linear drive characteristic of the hydraulic actuator 10 which is based on the output RPM and the RPM according to the RPM input signal, and proportional calculation, integral calculation, differential calculation, and double differential calculation which are based on the change amount of the output RPM and the RPM according to the RPM input signal. In this case, the n motors 140 operated to ensure the required amount of fluid may be operated by taking an efficiency of each pump 150 into consideration.

Figure 10:
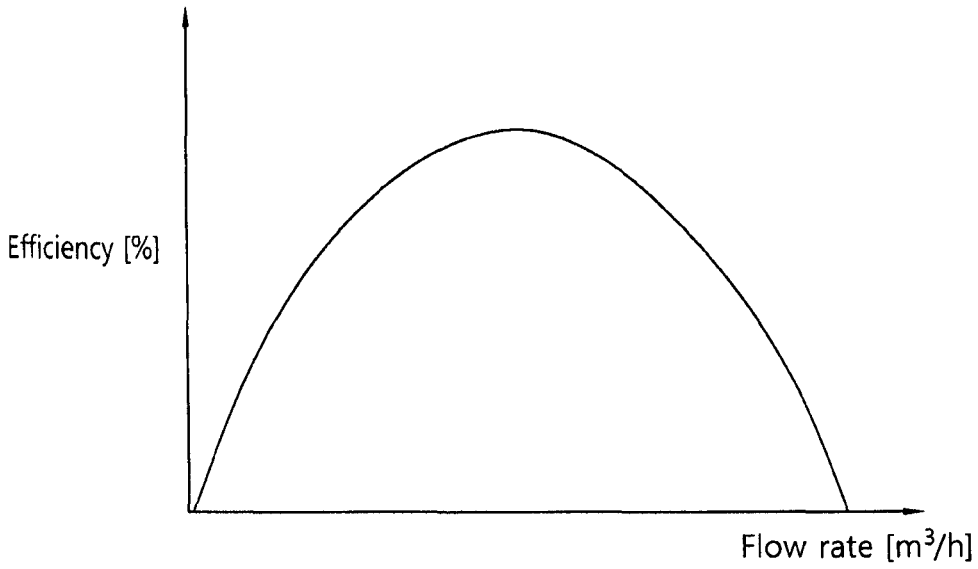
FIG. 10 is a graph illustrating an efficiency curve of a pump.

FIG. 10 is a graph illustrating an efficiency curve of a pump.

Referring to FIG. 10, it is preferred that the operation of the pump is avoided because a first region and a final region have a low efficiency of the pump, and the pump is operated because the efficiency of the pump is increased at a central part of an efficiency curve when an efficiency curve of the pump is equally divided into three regions.

Accordingly, in the present embodiment, the required flow rate output from each pump 150 is not ensured by dividing the pump 150 into n pumps, but the amount of fluid output from each pump 150 may be determined so that the required amount of fluid is ensured while minimizing total consumption power of the n motors 140.

In this case, the total consumption power of the n motors 140 may be calculated by a following equation 2.

$$W_{all} = \left(\sum_{i=1}^{n} Q_i \cdot \eta_i\right) \quad \text{[Equation 2]}$$

In the equation 2, the $W_{all}$ represents the total consumption power of the n motors, the $Q_i$ represents required amount of fluid in an i-th pump, and $\eta_i$ represents an efficiency of the i-th pump.

As a result, in the embodiment, in order to ensure the required amount of fluid, the RPM input signal may be transmitted to some of the motor servo loop controllers 300 connected to the motors 140 to be operated so that only some of the n motors 140 is operated but remaining motors 140 stop, or the RPM input signal may be transmitted to all of the n motor servo loop controllers so that the n motors 140 may be all operated. As described above, in the present embodiment, the flow for driving the hydraulic actuator 10 is scattered and generated by the n motors 140 and the n pumps 150, RPM of the proportional hydraulic control valve 161 and each motor 140 are controlled by the hydraulic servo loop controller 200 so that the output hydraulic pressure and amount of fluid can be efficiently controlled. Therefore, the method of controlling the mobile hydraulic generator according the embodiment of the present invention can ensure rapid response.

What is claimed is:

1. A mobile hydraulic generator comprising:

a storage tub configured to receive hydraulic oil returned from at least one hydraulic actuator;

a plurality of flow-generator subsystems, each of which comprises a motor servo loop controller and a flow generator, wherein the flow generator is connected to the storage tub, wherein the flow generator comprises a pump and a motor, wherein the motor generates an amount of flow of a hydraulic fluid, and wherein the motor servo loop controller controls the pump based on an RPM input signal;

a manifold having passages connected to the plurality of flow generators;

a hydraulic servo loop controller configured to select, from said plurality of flow generators, a number of operating flow generators and to generate RPM input signals for each of the motor servo loop controllers associated with the selected operating flow generators based at least in part on a required hydraulic pressure to operate the at least one hydraulic actuator; and a proportional hydraulic control valve to control output hydraulic pressure of the manifold to the at least one hydraulic actuator, wherein the hydraulic servo loop controller generates a pressure control signal for controlling the proportional hydraulic control valve.

2. The mobile hydraulic generator of claim 1, wherein the hydraulic servo loop controller generates the RPM input signals based on a change in the required hydraulic pressure.

3. The mobile hydraulic generator of claim 2, wherein, for each flow-generator subsystem, the motor servo loop controller generates an RPM output signal that is provided to the motor, said RPM output signal being based at least in part on a corresponding RPM input signal from the hydraulic servo loop controller.

4. The mobile hydraulic generator of claim 3, wherein the hydraulic servo loop controller is configured to select, from the plurality of flow generators, a plurality of operating flow generator subsystems, wherein for each operating flow generator subsystem of the plurality of operating flow generator subsystems, an RPM input signal is generated for the motor servo loop controller of the of the operating flow generator subsystem, the RPM input signal based at least in part on an efficiency of a flow rate of the pump of the operating flow generator subsystem.

5. The mobile hydraulic generator of claim 2, wherein each of the flow generators comprises, in addition to a pump, an RPM sensor configured to sense an output RPM of the pump, wherein for each flow generator, the motor servo loop controller associated with the flow generator receives a feedback signal from the RPM sensor, said feedback signal being indicative of the output RPM.

6. The mobile hydraulic generator of claim 1, wherein the manifold and the flow generators are coupled to an upper portion of the storage tub, wherein the manifold comprises a supply passage to supply the hydraulic fluid to one or more actuators, wherein the supply passage communicates with each of the pumps via communication passages.

7. The mobile hydraulic generator of claim 1, wherein each flow generator comprises a housing, wherein a communication passage is formed through a wall of the housing.

* * * * *